US011191367B2

(12) United States Patent
Arzanpour et al.

(10) Patent No.: US 11,191,367 B2
(45) Date of Patent: Dec. 7, 2021

(54) INFLATABLE CELLULAR CUSHIONING DEVICE FOR BODY SUPPORT

(71) Applicant: MOBISAFE SYSTEMS INC., North Vancouver (CA)

(72) Inventors: Siamak Arzanpour, North Vancouver (CA); Arina Aboonabi, Vancouver (CA); Hossein Dehghani, North Vancouver (CA); Maryam Soleimani, Port Coquitlam (CA)

(73) Assignee: MOBISAFE SYSTEMS INC., North Vancouver (CA)

( * ) Notice: Subject to any disclaimer, the term of this patent is extended or adjusted under 35 U.S.C. 154(b) by 148 days.

(21) Appl. No.: 16/326,335

(22) PCT Filed: Aug. 21, 2017

(86) PCT No.: PCT/CA2017/050988
§ 371 (c)(1),
(2) Date: Feb. 18, 2019

(87) PCT Pub. No.: WO2018/035604
PCT Pub. Date: Mar. 1, 2018

(65) Prior Publication Data

US 2019/0183257 A1 Jun. 20, 2019

Related U.S. Application Data

(60) Provisional application No. 62/377,632, filed on Aug. 21, 2016.

(51) Int. Cl.
*A47C 31/12* (2006.01)
*A61G 7/057* (2006.01)
(Continued)

(52) U.S. Cl.
CPC ..... *A47C 31/126* (2013.01); *A47C 7/142* (2018.08); *A47C 7/144* (2018.08); *A47C 31/008* (2013.01);
(Continued)

(58) Field of Classification Search
CPC ..... A61G 7/05776; A61G 7/05769; A61G 7/05715; A61G 2203/34; A47C 31/126; A47C 7/142; A47C 7/144; A47C 31/008
(Continued)

(56) References Cited

U.S. PATENT DOCUMENTS 5,163,196 A * 11/1992 Graebe ..... A61G 5/1043 5/654
5,267,364 A * 12/1993 Volk ..... A61G 7/05776 5/710
(Continued)

FOREIGN PATENT DOCUMENTS

WO WO 2018/035604 A1 3/2018

OTHER PUBLICATIONS

International Search Report and Written Opinion in corresponding International Patent Application No. PCT/CA2017/050988, dated Oct. 11, 2017, in 10 pages.

*Primary Examiner* — Myles A Throop

(57) ABSTRACT

An inflatable cushion for body support is described. The inflatable cushion can be adjusted to manually/automatically set the proper pressure distribution, remove pressure from sensitive regions, alternate pressure, facilitate moisture removal, automatically detect leakage and avoid bottom down, communicate leakage and other problems with the user/caregiver, detect wrong positioning and facilitate position correction. The inflatable cushion can be used either as a chair cushion such as for example as a cushion for wheelchair or as a bed mattress.

24 Claims, 11 Drawing Sheets

(51) Int. Cl.
*A47C 7/14* (2006.01)
*A47C 31/00* (2006.01)

(52) U.S. Cl.
CPC ..... *A61G 7/05776* (2013.01); *A61G 2203/34* (2013.01)

(58) Field of Classification Search
USPC ..... 5/655.3
See application file for complete search history.

(56) References Cited

U.S. PATENT DOCUMENTS 5,369,828 A * 12/1994 Graebe ..... A47C 4/54 5/654
5,561,875 A * 10/1996 Graebe ..... A61G 5/1043 297/180.13
5,634,224 A * 6/1997 Gates ..... A47C 27/081 5/654
5,651,151 A * 7/1997 Schild ..... A61G 7/05776 5/710
5,685,036 A * 11/1997 Kopfstein ..... A61G 7/05776 5/710
5,907,878 A * 6/1999 Thomas ..... A47C 4/54 5/706
6,189,168 B1 * 2/2001 Graebe ..... A47G 9/1027 5/490
6,253,401 B1 * 7/2001 Boyd ..... A47C 27/082 5/710
6,487,739 B1 * 12/2002 Harker ..... A61G 7/05707 5/423
6,623,080 B2 * 9/2003 Clapper ..... A47C 4/54 297/452.41
6,721,979 B1 * 4/2004 Vrzalik ..... A61G 7/05746 5/689
D645,284 S * 9/2011 Goeckel ..... D6/601
D647,344 S * 10/2011 Goeckel ..... D6/601
8,531,307 B2 9/2013 Lachenbruch
8,871,122 B2 * 10/2014 Fraser ..... B29C 65/48 264/46.4
9,044,367 B2 6/2015 Yakam et al.
9,675,505 B2 6/2017 Arzanpour et al.
9,782,312 B2 * 10/2017 Brubaker ..... A61G 7/05792
9,820,904 B2 * 11/2017 Lafleche ..... A61H 23/04
2003/0121102 A1 * 7/2003 Brubaker ..... A61G 7/05707 5/654
2009/0100604 A1 * 4/2009 Caminade ..... A61G 7/05776 5/713
2009/0237264 A1 * 9/2009 Bobey ..... A61B 5/6891 340/815.69
2010/0212089 A1 8/2010 Kajiwara et al.
2011/0296621 A1 * 12/2011 McKenna ..... A61G 7/05776 5/671
2014/0068869 A1 * 3/2014 Lafleche ..... A61G 7/05792 5/724
2014/0223665 A1 * 8/2014 Chapin ..... A61G 7/05776 5/710
2016/0183693 A1 * 6/2016 Shih ..... A47C 27/085 5/655.5
2017/0156519 A1 * 6/2017 Cheng ..... A47C 7/142
2020/0221821 A1 * 7/2020 Wijesundara ..... A43B 13/182

* cited by examiner

INFLATABLE CELLULAR CUSHIONING DEVICE FOR BODY SUPPORT

FIELD OF INVENTION

The invention relates to an inflatable cushioning device such as a sitting cushion or mattress, and more specifically to an inflatable cellular cushioning device with an adjustable inflation pressure.

BACKGROUND OF INVENTION

Unless otherwise indicated herein, the materials described in this section are not prior art to the claims in this application and are not admitted to be prior art by inclusion in this section.

Cushions, mattresses and overlays have been used to help patients in treatment or prevention of pressure sores. The most commonly used methods are improving the diffuse load over a wider area (to reduce pressure points) or by alternating the inflation pressure in the adjacent cells (to change the location of pressure points). However, in the known inflatable cushions or mattresses the sitting area is not divided into multiple zones and various zone arrangement settings where a pressure distribution is adjusted independently in each of the sitting zones according to the user's preference or sitting position.

SUMMARY OF THE INVENTION

In one aspect, an inflatable cushioning device for body support is provided. The inflatable cushioning device comprises a plurality of inflatable cells such that each inflatable cell has a bottom and an air sealed wall defining an inner cavity of the inflatable cell. The plurality of inflatable cells comprises an entrance (inlet) port to provide an access to the inner cavity of the plurality of inflatable cells. The inflatable cushion further comprises an inflation system with a fluid flowing system and a fluid regulator. The inflation system is configured to inflate and deflate the plurality of inflatable cells. One or more sensors are in communication with the plurality of inflatable cells and are configured to measure at least one parameter of the plurality of inflatable cells. A controller that has an input unit, an output unit and a processing unit is in communication with the one or more sensors and the inflation system to receive a signal from the one or more sensors as input information, and to send a trigger signal to the inflation system. The cushioning device further comprises a remote controller that has an input interface to provide input information to the controller and an output interface for the operator to observe parameters of the inflatable cushioning device and its settings. The controller uses the input information obtained from the one or more sensors and the input information provided by the operator using the remote controller to actuate the inflation system and adjust the pressure in the inflatable cells based on such input information.

In one aspect, the inflatable cells are interconnected together using a network of channels. The inflatable cushioning device further comprises at least one plug configured to be inserted at a pre-determined position in the network of channels to block the channel at such position and terminate the connection between the inflatable cells forming separate and independent cell zones. The size and shape of each cell zone is adjustable by repositioning the at least one plug. The entrance port provides access to the inner cavity of all inflatable cells in each of the cell zones. The controller is in communication with each of the cell zones to independently adjust the pressure therein. The independent cell zones and/or individual inflatable cells are arranged into a pre-determined pattern.

In one aspect, a flow channel configured to connect two or more cell zones is provided to allow fluid communication between the inflatable cells of the two or more cell zones. A valve is mounted to the flow channel and the controller is in communication with the valve to control the fluid flow between two or more cell zones.

In another aspect, the inflatable cushioning device comprises at least two cushioning layers of plurality of inflatable cells such that the plurality of inflatable cells in an upper cushioning layer are stacked over the plurality of inflatable cells in a lower cushioning layer. A dividing plate mounted between the at least two cushioning layers can be provided so that the plurality of inflatable cells in the upper layer are attachable to the dividing plate.

In one aspect, the inflatable cushioning device comprises a moisture removal system. The moisture removal system comprises a flexible hose with a porous wall and an air flow system in communication with the hose. The hose is positioned between the plurality of the inflatable cells in proximity to a top surface of the cushioning device. The controller is in communication with the air flow system of the moisture removal system to actuate an air flow through the hose.

In one aspect, the controller is programmed to automatically determine an optimal pressure in each of the plurality of inflatable cells based on user's parameters and needs.

In another aspect, the controller is programmed to automatically alternate pressure in different cell zones in order to provide alternating pressure distribution in the cell zones. The timing and sequence of the pressure alternation is pre-determined based on user's needs.

In one aspect, a method for adjusting the pressure in the inflatable cushioning device is provided. The method comprises the steps of: overinflating a plurality of inflatable cells; determining an optimal pressure in each of the plurality of inflatable cells or cell zones based on input information obtained from a remote control device; deflating the cells; measuring at least one parameter of each of the cells or cell zones using one or more sensors and providing a signal of such parameter in real time to a controller; and stopping a deflation process in the cell or cell zone when a value of the measured parameter is at a predetermined value.

In another aspect, the method can comprises the steps of: providing input information of at least one user's parameter to a controller using a remote control device; the controller determining an optimal pressure in each of a plurality of inflatable cells of the inflatable cushioning device based on the input information and inflating each of the plurality of inflatable cells to the determined optimal pressure.

In addition to the aspects and embodiments described above, further aspects and embodiments will become apparent by reference to the drawings and study of the following detailed description.

BRIEF DESCRIPTION OF THE DRAWINGS

Throughout the drawings, reference numbers may be re-used to indicate correspondence between referenced elements. The drawings are provided to illustrate example embodiments described herein and are not intended to limit the scope of the disclosure. Sizes and relative positions of elements in the drawings are not necessarily drawn to scale. For example, the shapes of various elements and angles are not drawn to scale, and some of these elements are arbitrarily enlarged and positioned to improve drawing legibility.

FIG. 10A is a side view of interconnected inflatable cells showing connection channels therein between.

DETAILED DESCRIPTION OF SPECIFIC EMBODIMENTS

The present invention describes an inflatable cushioning device for body support which can be adjusted to: manually or automatically set the proper pressure distribution, remove pressure from sensitive regions, alternate pressure, facilitate moisture removal, automatically detect leakage and avoid bottom down, communicate leakage and other problems with the user/caregiver, detect wrong positioning and facilitate position correction. The inflatable cushioning device can be used either as a chair cushion such as for example a cushion for wheelchair or as a mattress. The cushioning device of the present invention can have multiple sitting zones with multiple arrangement settings that can be defined based on user's need/preference. The arrangement and state of each sitting zone can be easily defined or adjusted by a user or any expert in the field through a remote control, a smart phone or a computer. Moreover, such state of sitting zones can automatically change based on smart algorithms incorporated to a control unit. Therefore, the cushioning device can act alternatively both as a static air cushion with the desired state of sitting zones and as a dynamic cushion which adapts to user's need over time. Moreover, by smart alternation of the inflation pressure in specific zones, the inflatable cushioning device of the present invention combines ideal pressure distribution and alternation in the required areas in order to prevent or ameliorate pressure sores.

Figure 4:
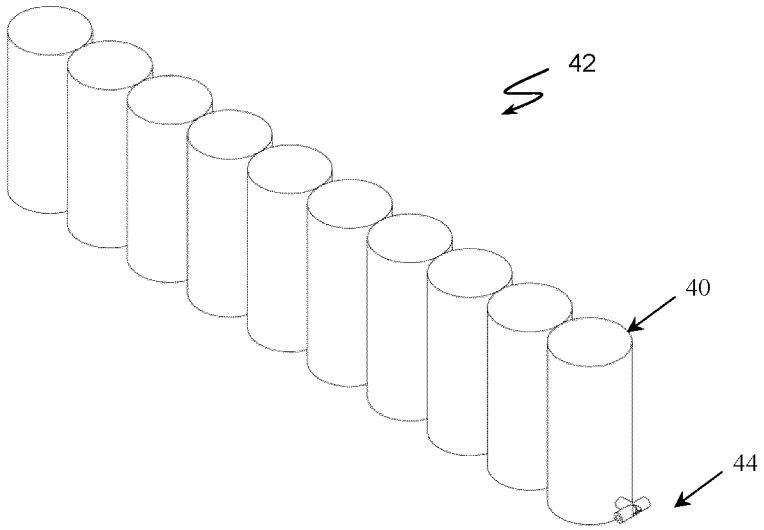
FIG. 4 is a perspective view of an example of interconnected inflatable cells with circular shape forming a cell zone.
Figure 5:
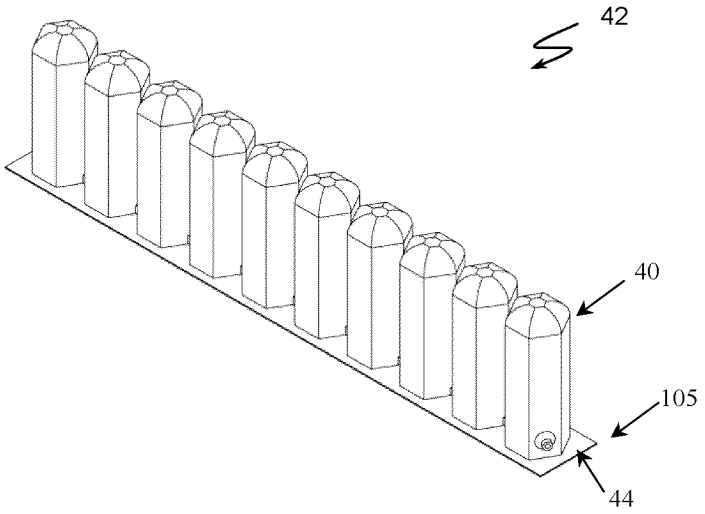
FIG. 5 is a perspective view of an example of a cell zone form by interconnected inflatable cells with hexagon shape.

The inflatable cushioning device 100 (FIG. 6) can be a sitting cushion or mattress or any other sitting or resting inflatable cushioning device. The cushioning device 100 can comprise a controller 10 (FIGS. 1 and 2), a user interface device 30 (FIG. 3) and a plurality of inflatable air cells 40 grouped to form at least one cell zone 42 (FIGS. 4, 5). The inflatable air cells 40 can be interconnected together or can be independent one from another. For example, the at least on cell zone 42 can be formed from a plurality of interconnected cells 40 or the cell zone 42 can be a single cell 40. Each cell zone 42 has an inlet means comprising at least an entrance (inlet) port 44 to provide passage to an inner cavity of the cells 40.

Figure 1:
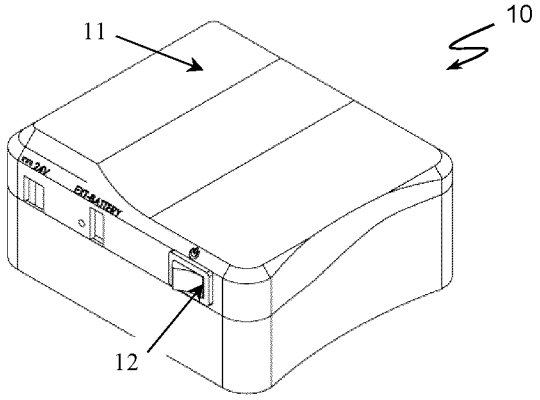
FIG. 1 is a perspective view of an example of a control box for controlling and adjusting pressure in an inflatable cellular cushioning device of the present invention.
Figure 2:
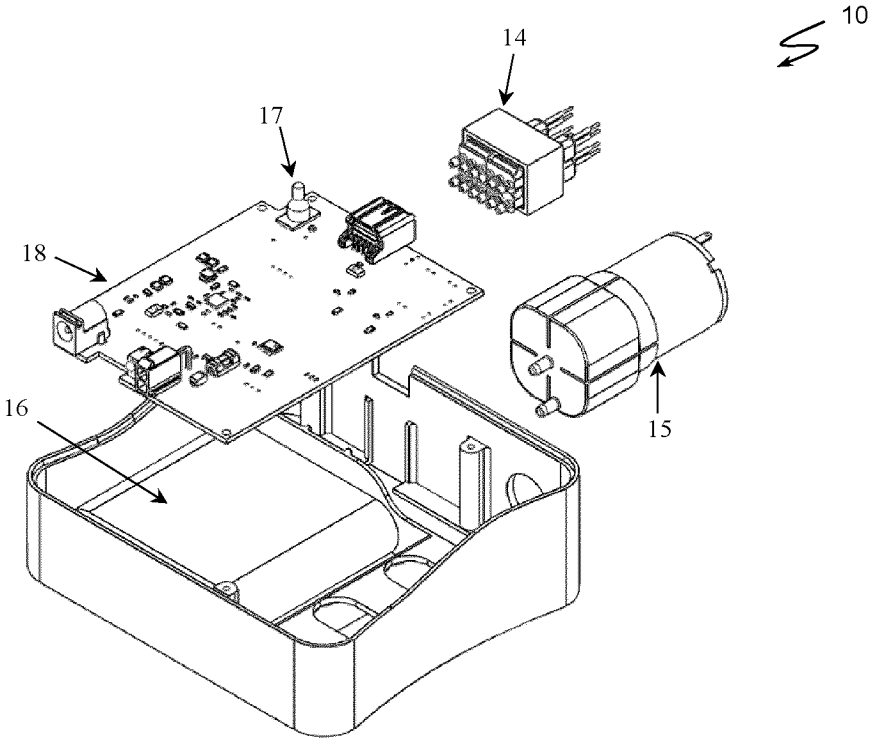
FIG. 2 is an exploded view of the control box of FIG. 1 showing the inner components of the control box.

FIG. 1 illustrates one example of the controller 10 that is configured to adjust the pressure distribution in the inflatable cells 40 of each cell zone 42. The controller 10 can include an enclosure box 11 containing control electronics and a power switch 12 for turning on and off the controller 10. The control electronic can comprise at least an input unit, a processing unit and an output unit. FIG. 2 shows the inner components of the controller 10 including a power source, such as for example, a battery 16 with a battery management unit and an electronic board 18 with at least an input unit 17, an output unit 14, a memory unit and a processing unit. The input unit 17 of the controller 10 in in communication with at least one sensor to receive an input signal from the at least one sensor. For example, the at least one sensor can be a pressure sensor or a flow meter or any other suitable sensor which can be in communication with the cells 40. The at least one sensor is configured to measure the pressure in each of the inflatable cells 40 and provide the measured signal as an input signal to the input unit 17 of the controller 10. The input signal is then process by the processing unit and an output signal is provided by the output unit 14. For example, the output unit 14 can be in communication with an inflation system to provide fluid flowing in or out of the cells 40. The inflation system can comprise a fluid flowing system, such as for example one or more electric pumps 15, and a fluid regulator, such as for example one or more valves that are configured to open or close the inlet port 44. Thus, the outlet unit can send a trigger signal as an output to actuate the one or more pumps 15 (start on/off the pumps) and the one or more valves (open/close the valves) to inflate or deflate the cells 40 in the zone 42.

In one implementation, the configuration of the valves can be such that there is an individual path between pump 15 and each of the cell zones 42 such that each of the cell zone 42 can be independently control and adjust. In one embodiment, the valves can be connected to the cells 40 through air tubes. The one or more sensors can be a pressure sensor, a flow meter or any other sensor that can feed signals to the controller 10 to determine pressure in the cells 40. The cushioning device 100 can include any other suitable and known inflation system required for controlling and adjusting the pressure in the inflatable cells 40 based on the input information obtained from the sensor(s) and the preferable (pre-determined) or desired settings parameters.

Figure 3:
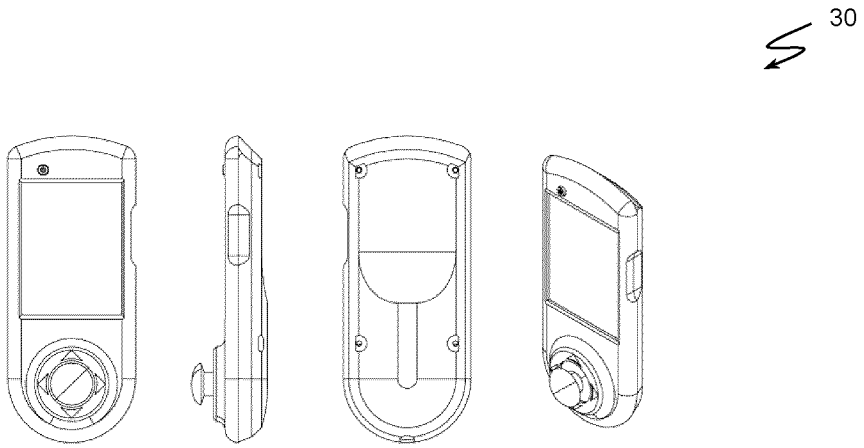
FIG. 3 shows various views of an example of user remote control device used for controlling an inflatable cellular cushioning device of the present invention.

FIG. 3 shows the user interface device 30 (e.g. a remote control) that is an interface for a user, a caregiver, a doctor or an Occupational Therapist (OT) to communicate with the controller 10. It can be a touch screen, a joystick, a remote computer, a laptop, a smart phone or any other suitable user interface. In some implementations, the user interface 30 can have a voice recognition capability. The remote device 30 can communicate wired or wirelessly with the controller 10. In one exemplary embodiment, the remote 30 can have a screen, e.g. a LCD with touch screen capability. All the information regarding the current state of the cell zones 42 can be displayed on the screen of the device 30. The operator can change the state of the cell zones 42 manually or can select automatic adjustment. The operator (user or the caregivers/experts) can customize the cushioning device 100 based on the user's requirement and can save the settings in the controller's memory identifying the setting with an ID name. Such customized and default settings can be chosen by the operator through a menu shown, for example, on the screen of the user interface 30. In addition, the device 30 can provide the opportunity for the operator to interact with the cushioning 100 and override the process determined by the controller 10. The device 30 can further comprise a joystick (not shown), so that the operator can easier navigate through options and settings. In one embodiment, a mobile application run on a mobile device (phone, tablet, etc.) can be developed to serve as a user interface device 30.

The controller 10 is configured to control and adjust the pressure in the inflatable cells 40. The inflatable cells 40 can be made from silicon, natural or synthetic rubber or any other suitable material that can seal air. The cells 40 can have circular, rectangle, star or any other shape. For example, FIG. 4 shows cell zone 42 with inflatable cells 40 with circular shape while FIG. 5 shows a cell zone 42 with inflatable cells 40 with hexagonal shape. In general, the cross sections that help better bulging of the cells 40 are preferred. In one embodiment, a single inflatable cell zone 42 can have inflatable cells 40 with different shapes. The cell zones 42 can comprise one or more entrance (inlet) ports 44, an inflation device, such as for example one or more pumps that are in communication with the inlet ports 44 to pump in/out a pre-determined amount of fluid (e.g. air) in/out of the cell's inner cavity. The cells 40 can be interconnected with a network of channels so that the fluid (air) can flow from one cell 40 to the others cells 40 in the cell zone 42. The height of the cells 40 can be selected such that it helps better bulging and cell's tilting to fill the gap between cells to help pressure distribution in the zone 42. The arrangement and number of the cells 40 in the zone 42 can be selected based on the user's hip size and special needs. The cells 40 can be grouped together by internal connecting channels (see FIG. 10) or by external connections using a flow channel (pipe or tube) to make regions/zones 42 that can be independently controlled. The number of the cell zones 42 depends on user's special needs. The locations of the cells 40 can be adjustable which means that the shape of the regions/zones 42 can be changed and adjusted as well.

Figure 6:
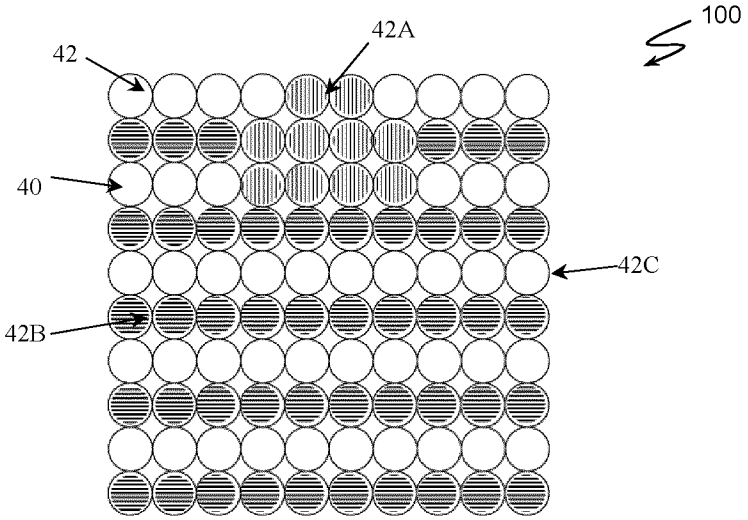
FIG. 6 is a top view of an example of an inflatable cellular cushion showing three separate cell zones of interconnected inflatable cells.

FIG. 6 shows one example of an inflatable cushioning device 100 with a plurality of inflatable cells 40 interconnected and arranged forming a plurality of cell zones 42. The inflatable cells can be connected to a base 105 (see FIGS. 5 and 8) of the cushion 100. The base 105 can be a hard plate (e.g. wooden or plastic plate) or a soft plate (foam, rubber). In one implementation, the base plate 105 can be inflatable as well and the controller 10 can be in communication with the base plate 105 to adjust the pressure in the base plate 105. In another implementation, the base plate can be avoided and the bottom wall of the inflatable cells 40 can form the base of the cushioning device 100. In the illustrated example of FIG. 6, there are three independent regions or zones 42, identified as zone 42A, zone 42B and zone 42C. This is for illustration purposes only and the number, size or shape of the independent cell zones 42 can be adjusted based on users' needs without departing from the scope of invention. Each of the zones 42 is separated from the others, such that there is no air flow between cells 40 from one zone 42 to the cells 40 from another zone 42. Each of the zones 42A, 42B and 42C can be independently controlled by the controller 10. A single controller 10 can control each of the zones 42A, 42B, 42C or more than one controller 10 can be used. Each zone 42 of interconnected cells 40 can be controlled independently by connecting each cell zone 42, i.e. the inlet port 44 of each cell zone 42, to the inflation device (air pump) through the valve 14 to inflate in or to exhaust out the inflation fluid from the cells 40 and thus inflate or deflate such region (zone) 42. For example, the cells 40 of zone 42A are not connected with any cells 40 of zones 42B or 42C. The cells 40 of zone 42A can be for example at a central position to support user's tailbone and hips when the user is in sitting position. The cells 40 of zone 42B can be located in the odd horizontal rows while the cells 40 of zone 42C can be located in even horizontal rows. Such arrangement of cell zones 42A, 42B and 42C can bring flexibility to provide different arrangements of adjustable cushioning device 100 depending on the user's requirements. For example, zone 42A can be independently controlled to address pressure ulcer. The cells 40 of zone 42A can be located in an area which is more vulnerable to be affected by this medical condition. For example, in such embodiment the pressure in the cells 40 of the zone 42A can be adjusted independently or it can be fully deflated. In one embodiment, some of the cells 40 can be located inside zone 42A, but not controlled with the rest of the cells 40 of this zone. These cells can be assigned to avoid the injured area having contact with the hard surface of the cushion 100.

In one implementation, the zone design can be used for pressure alteration. The main reason for pressure alteration is to provide pressure relief on sitting area and enhance blood flow to avoid skin damage. The cells 40 in zones 42B and 42C or all three zones 42A, 42B, 42C, can be set to inflate and deflate alternatively to remove the pressure from the body parts while avoiding to move the user up or down significantly. The timing and sequence of pressure alteration can be manually determined by the operator (user or the caregiver). Zone 42A can also be included in the pressure alteration sequence if needed or the pressure can alternate only in zones 42B and 42C.

In another implementation, the plurality of cell zones 42 can be connected using a flow channel and a valve positioned between two cell zones 42 so that the flow channel provides fluid communication between the cells 40 of the two cell zones 42. The controller 10 can be in communication with such flow valve to connect two cell zones 42 (when valve therein between is opened) or to disconnect such two cell zones 42, when the flow valve is closed.

In one embodiment, the user interface 30, can include different operation modes, such as for example, a comfort mode, a healing mode and an alternation mode. When the comfort mode is selected by the user, using the remote 30, the controller 10 will automatically connect cells 40 of all independent zones 42, e.g. zones 42A, 42B and 42C, together and set the inflation pressure in all zones 42 to the optimal pressure suitable for such setting. Therefore, the cushioning device 100 will act as a static air cushion in this mode while its internal pressure is set to optimal by using a smart algorithm. In healing mode, the controller 10 will connect some zones, e.g. zones 42B and 42C, while isolating the area under ischial bones such as for example zone 42A, and will reduce inflation pressure of cells 40 in zone 42A automatically, such that the contact pressure in that area becomes minimal. The inflation pressure on the rest of the zones 42B and 42C can then reach the optimal pressure required to ensure that body weight is properly distributed over and tolerated by such zones 42. In alternation mode, the controller 10 can selectively include or exclude each zone 42 from the cycle. At the beginning of the cycle, all of the zones 42 included in the alternation mode can get connected to each other and they can be inflated to the optimal pressure set by the controller 10. Then they are separated from each other and while the inflation pressure changes in one zone 42, the pressure in other zones 42 can be set at an optimal pressure. Each mode can be modified by changing its settings through the user interface. Customized settings can also be defined and saved in the system by using the user interface 30.

Figure 7:
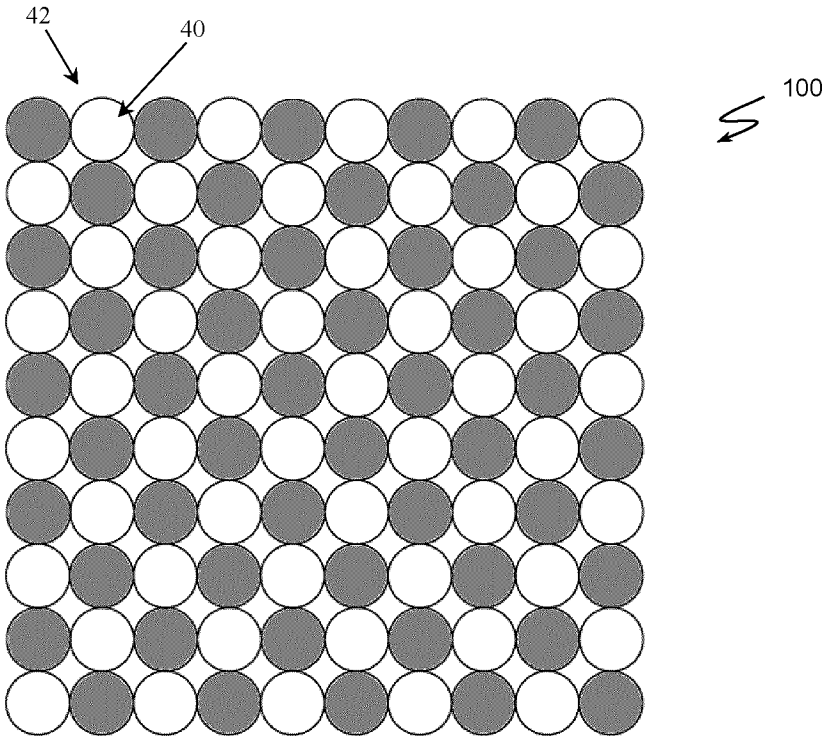
FIG. 7 is a top view of an example of an inflatable cellular cushioning device with inflatable cells in arrow arrangement with two cell zones connected diagonally.

The number of zones 42 and zone arrangement (configuration) can vary depending on user preference and needs without departing from the scope of the invention. For example, FIG. 7 shows cell zones 42 in arrow arrangement, where cell zones 42 are positioned in alternating diagonals.

Figure 8A:
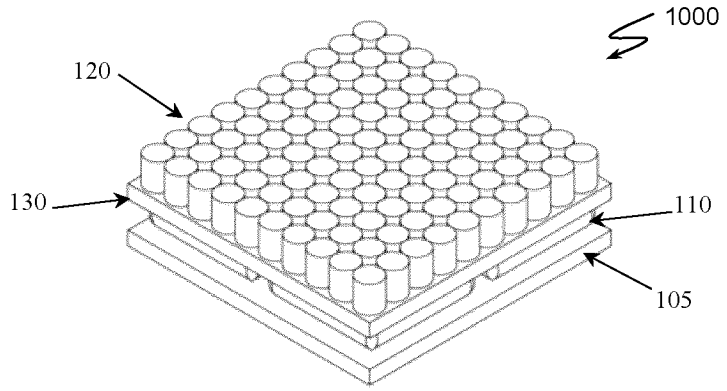
FIG. 8A is a perspective view of an example of an inflatable cellular cushioning device with multiple layers.
Figure 8B:
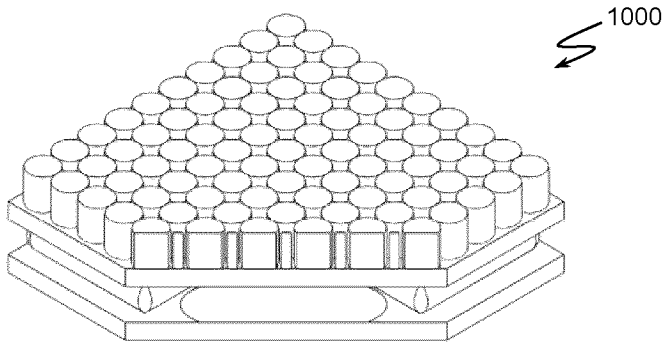
FIG. 8B is a perspective, cross-sectional view of an inflatable cellular cushioning device of FIG. 8A showing the multiple layers.
Figure 8C:
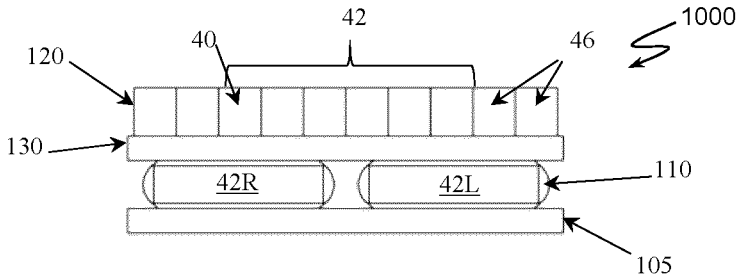
FIG. 8C is a front, cross-sectional view of an example of an inflatable cellular cushioning device with multiple layers.
Figure 8D:
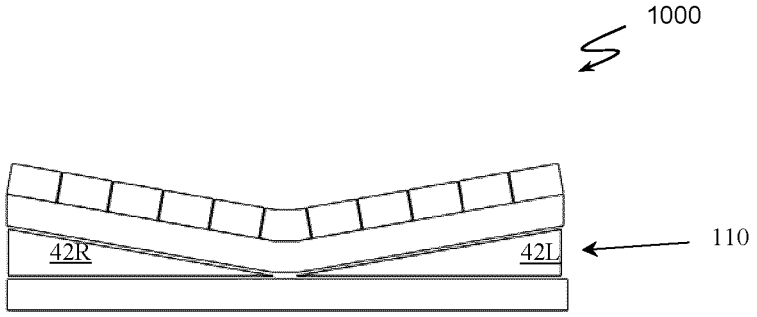
FIG. 8D is a front, cross-sectional view of an example of an inflatable cellular cushioning device with multiple layers and inflated bottom layer.

In one implementation, the cushioning device 100 can have one or more layers of inflatable cell zones 42. FIGS. 8A-8D show a cushioning device 1000 that comprises a bottom cushioning layer 110 and a top cushioning layer 120. The cushioning device 1000 can further comprise the base 105 and a dividing layer 130 positioned between the two layers 110 and 120. The dividing layer 130 can be an inflatable layer, a cushioning (soft layer), such as a foam layer or a hard solid plate. The cells 40 of the top layer 120 can have different heights and shapes than the cells 40 of the bottom layer 110. In addition, each of the top and the bottom layers 120, 110 can have one of more cell zones 42. The distribution of the cells 40 in each of the layers 110, 120 in the cushion 1000 can be even/symmetric or not without departing from the scope of the invention. In one implementation, the top layer 120 of the cushion 1000 can further comprise surrounding cell zones 46 independent from cells 40 of the cell zones 42. In one embodiment, the surrounding zone 46 can be externally connected to the rest of the cell zones 42 for better pressure distribution. The surrounding cell zones 46 can comprise one or more inflatable cells and can be configured to help with user stability and position when body moves left or right. The surrounding cells 46 can be slightly over inflated and then locked individually or as a zone. The shape of the surrounding zones 46 can be different to allow less pressure exchange with other cell zones 42 or to be more resistant to deformation. In one embodiment, the left and right surrounding zones 46 can be inflated together, but such left and right surrounding zones 46 are not interconnected so that they can be inflated/deflated independently. Thus, each of the surrounding zones can be independently controlled. For example, if the user has tendency to lean toward one side, that side can be more resistant (inflated) to avoid losing stability and correct the user position. The cells 40 of the cell zones 42 or the surrounding zones 46 can be a hybrid or combination of foam (e.g. polyurethane) and air cells. For example, the surrounding cells 46 can be foam cells while cells 40 can be air cells. In one implementation, some of the cells in the cell zones 42, 46 can be foam cells while other can be air cells. The air cells can be uniform or stacked. The stacked air cells can have some advantages including good elevation without significant change of the air cells deformation, flexibility to bend sideways and flatter surfaces. In one implementation, the bottom layer 110 of the cushion 1000 can also have several cell zones 42. The main responsibility of the bottom layer 110 is to correct user's position. In one embodiment, the bottom layer 110 can comprise two independent zones 42L (left) and 42R (right). If the user leans toward left, the 42L zone will be inflated to push the user back to the correct position. FIG. 8D shows a cushioning device 1000 in which the cell zones 42L and 42R of the bottom layer 110 are designed as a wedge. For example, the zones 42L and 42R can be a single inflatable cell 40 shaped as a wedge when inflated or can include multiple cells 40 with different height. In one embodiment, the cell zones 42L and 42R can be non-inflatable (e.g. a foam cell). The bottom layer 110 and/or the top layer 120 can have more than two zones without departing from the scope of the invention. In one implementation, the top layer 120 of the cushion 1000 can be made of a multiple layers made of foam, gel or any other malleable material that can take the contour of the hip area. The bottom layer 110 can be made of multiple zones of air cells 40. Each zone can consist of a single or multiple air cells 40. The order of the layers can be reversed such that the air cell layer is the top layer 120 and the foam, gel layer can be the bottom layer 110.

Figure 9A:
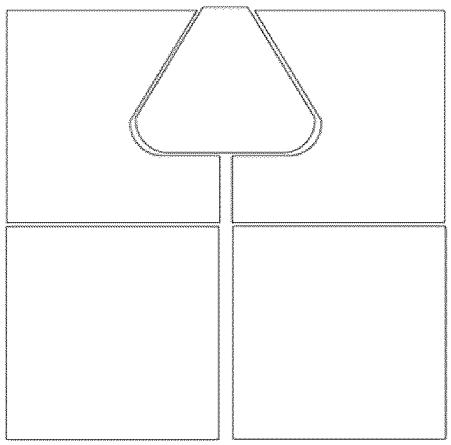
FIG. 9A is a top view of an example of an inflatable cellular cushioning device with five cell zones of interconnected inflatable cells.
Figure 9B:
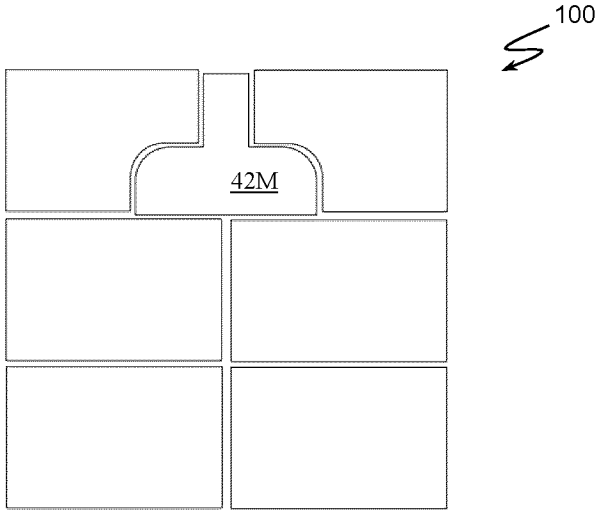
FIG. 9B is a top view of an example of an inflatable cellular cushioning device with seven cell zones of interconnected inflatable cells.

FIG. 9A shows the cushioning device 100, 1000 that comprises four cell zones 42, two in the front and two in the back. All of these zones can be controlled independently. The two front zones are responsible to push the user to sit back on the cushion 100, 1000. In addition, such arrangement can be used to correct leaning of the user to the right or left as explained herein above. The inflatable cells 40 can also be used to adjust the elevation/height of the cushion 100, 1000 by using cells 40 with different heights. For example, the height of the cells in the surrounding zones 46 (in the top or the bottom layer 120, 110) can be higher than the height of the other (centrally positioned) cells 40 to maintain the proper/desired position of the user. FIG. 9B shows another embodiment of the cushioning device with seven cell zones 42 in which the middle zone 42M can be used to provide pressure relief.

In one embodiment additional sensors such as moisture and water sensors can be placed in the cushion 100, 1000 to report if the user spill liquid on the cushioning device 100, 1000 or in case of uncontrolled urination. The cushion 100, 1000 can be equipped with a moisture removal system (not shown). For example, the moisture removal system can include a long flexible hose made of plastic, rubber or any similar material with multiple holes made in the wall of the hose. In one embodiment the hose can be made of a fabric with sufficient porosity to let the air escape. The hose is placed inside the top layer cushion. The placement of the hose can be in different ways (e.g. straight, wrap around each cells or some cells). The hose can be in fluid communication with the fluid flow system (e.g. air flow system) such that the air can be provided through the hose. The flow system can be for example, a suction system (pump) to extract moisture or excess liquid out of the cushion. The controller 10 can trigger the fluid flow in pre-set time intervals to remove moisture from the cushion 100, 1000. The time interval can be set and/or changed by the user, medical expert, or caregiver using the remote controller 30.

In one implementation, the controller 10 can be programmed with a pressure leak detection algorithm. The air leak can be detected by monitoring the pressure sensor in real-time or at intervals. If the pressure is constantly decreasing that indicates a leak which can be a result of hole(s) in one or more of the cells 40 or failure of the connectors, such as the inlet ports 44. In these situations the controller 10 can send a signal to the pump to maintain the optimal pressure or any prescribed pressure to avoid bottom down by increasing the flow rate. In addition, an alert signal will be generated for the user, caregiver or medical experts to let them know about the detected leak. The signal can be sent wired or wirelessly. The cushion 100, 1000 can be designed so that problems with leakage can be easily fixed by changing the damaged cell 40 or changing the entire cell zone 42. In one implementation, the cell zones 42 can be removably attached to the base 105 or dividing plate 130. The cell zones can be attached to the base 105 or dividing plate 130 using Velcro, snaps, etc. When the controller 10 identifies a cell 40 of a cell zone 42 that has a hole and is leaking, instead of changing the cushion or fixing the puncture, that zone 42 can be detached and replaced. In one embodiment, the repeating patterns in the zones (rows) can be made separately and attached externally. Similarly, in case of puncture, only the affected row will be replaced. In another embodiment, the pattern of interconnection can be made and each cell can be attached to the base 105 and/or dividing plate 130 by snap or other air-sealed connection so that only the damaged cell 40 can be replaced.

Figure 10A:
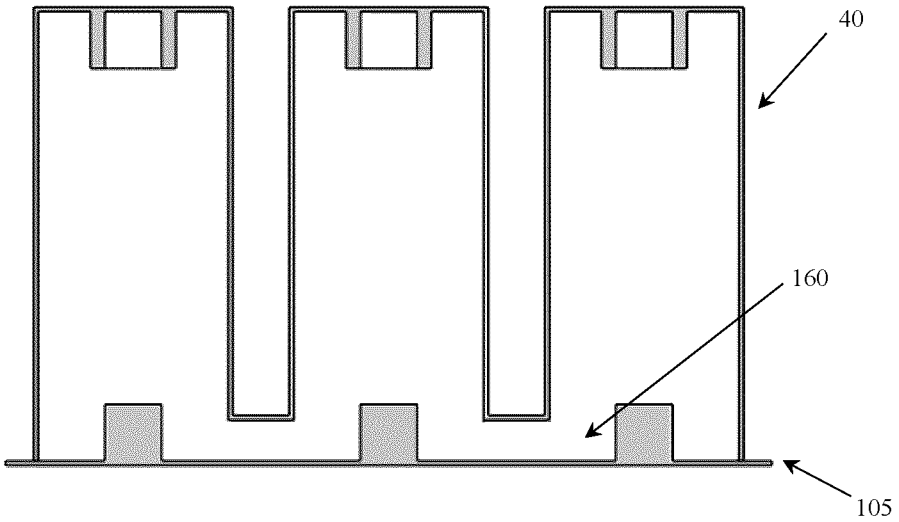
Figure 10B:
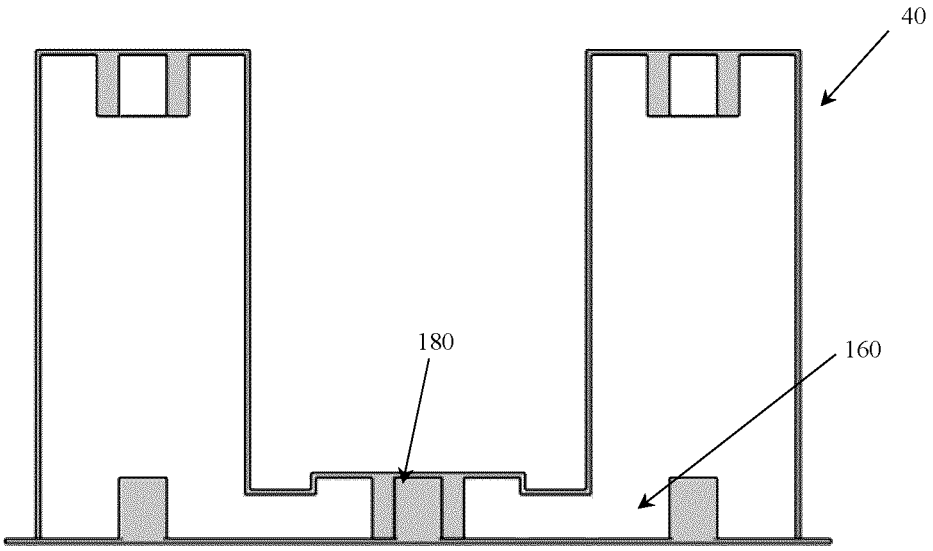
FIG. 10B is a side view of interconnected inflatable cells showing a connection channel that is blocked to disconnect the adjacent inflatable cells.

FIG. 10A shows a plurality of cells 40 interconnected with internal lockable channels 160. To define cell zones the connection between cells 40 can be terminated by blocking the channel 160. This can be done manually by blocking the channel 160 at the pre-determined location by inserting a plug 180 at such pre-determined location thus closing the channel or channels (FIG. 10B). In one embodiment, some of the cells 40 can be disconnected from the base 105 and the inlet and channel 160 to such cell 40 can be closed using one or more plugs 180. In another embodiment this can happen by pushing the top of the cell to snap in button placed on the base or go inside the inlet and close it. In one embodiment a piece of fabric or another part of appropriate shape (soft or hard) can be used to disengage a region or some required cells. The fabric can snap in the base to prevent those cells from inflation.

Figure 11:
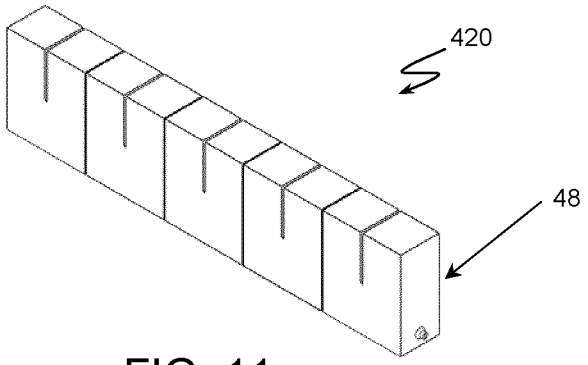
FIG. 11 is a perspective view of an example of interconnected inflatable cells with square shape where each cell splits into two connected cells on the top.
Figure 12A:
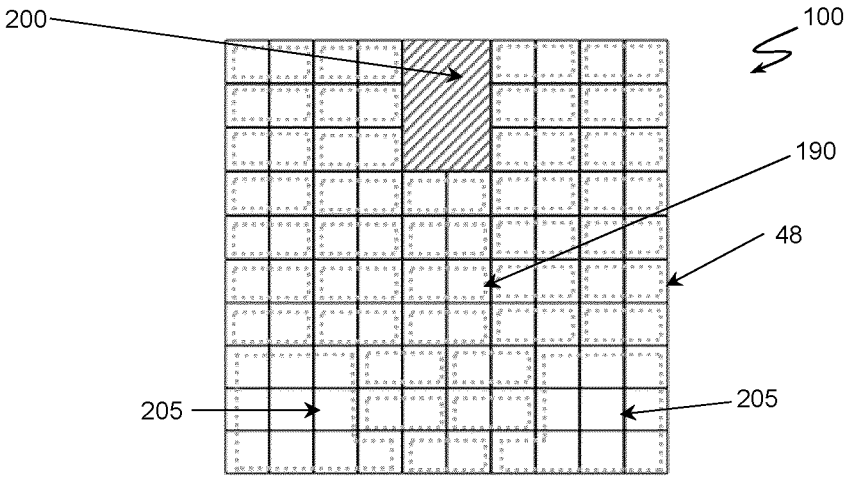
FIG. 12A is a top view of an example of an inflatable cellular cushioning device with increased cell size on the edges and load bearing areas.

In one embodiment, the stability of the air cushioning device 100, 1000 is improved by reducing the height of cells 40 or by increasing the cross section of the cells 40. FIG. 11 illustrates an example of a split cell 48 in order to increase the cross section of the inflatable cells. The number of split cells 48 can be interconnected to form a cell zone 420 as shown in FIG. 11. The split cell 48 can comprise a lower part 47 and an upper part 49. The upper part 49 of the split cell 48 can comprise a set of two or more air cells with smaller cross-section and of the lower part 47 can comprise a single air cell with bigger cross section such that the lower part 47 is a base for the upper part 49. The split cells 48 can be used as part of the top layer in case of a multilayered cushioning device 1000. The split cell design can be used to increase the stability of the cushioning device 100, 1000 or to provide better contouring of the cushion to match the shape of the contact body, while providing more stability at the base. An example of cushion 100, 1000 with split cells 48 is illustrated in FIG. 12 A. The area 190 consists of inflatable split cells 48 which can be grouped in one or more cell zones 420. The cushioning device 100 illustrated in FIG. 12A can further comprise a front cell zone 200 that can comprise a number of inflatable cells 40 or can consist of foam or other materials. In addition, the cushioning device 100 can comprise one or more back cell zones 205.

Figure 12B:
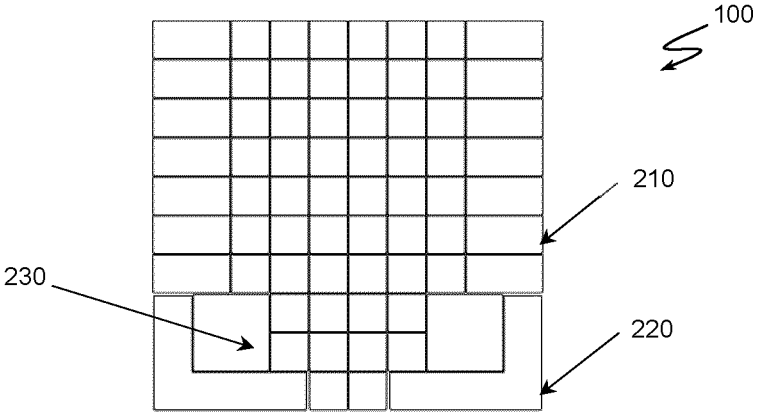
FIG. 12B is a top view of an example of inflatable cellular cushioning device with split inflatable cells.

FIG. 12B illustrates another example of a cushioning device 100 which includes some cells with bigger cross sections 210, 220 and 230 for improved side stability and also enhanced stability and support of load bearing areas, such as pelvis.

Figure 13A:
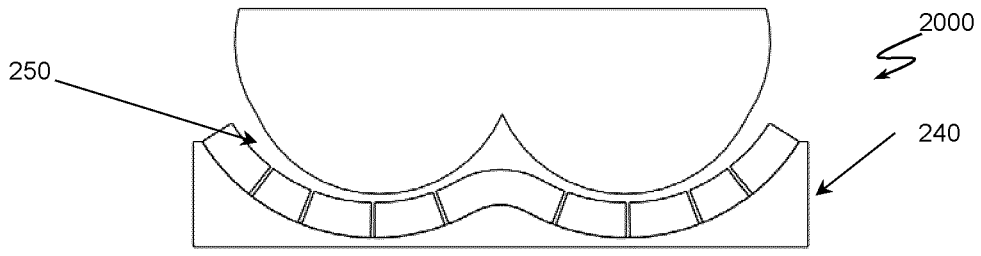
FIG. 13A is a rear view of an example of a contoured cushioning device with inflatable air cells covering the sitting area.
Figure 13B:
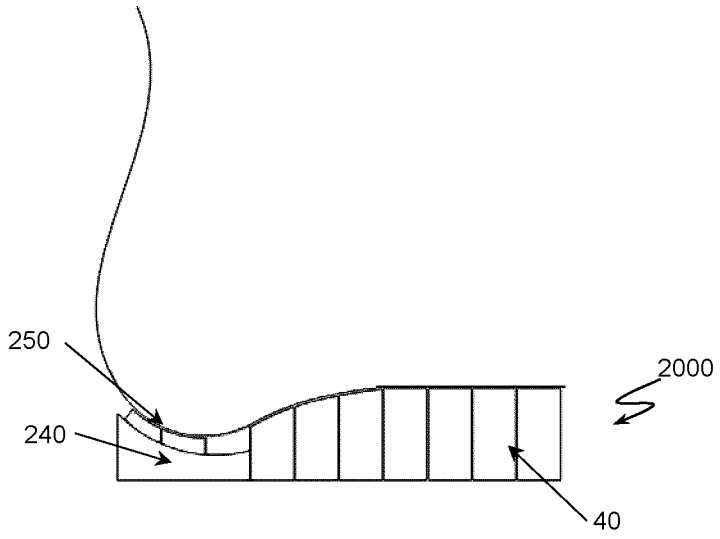
FIG. 13B is a side view of an example of a contoured cushioning device with inflatable air cells covering the sitting area.
Figure 13C:
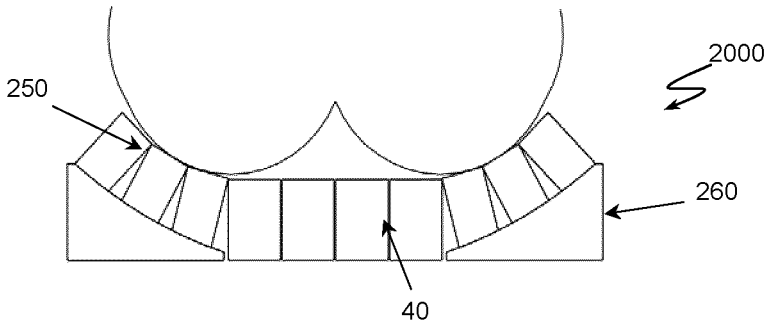
FIG. 13C is a rear view of an example of an air cushioning device with wedges to support the load bearing area.

FIG. 13A shows a cushioning device 2000 that comprises a contoured base surface 240 and a number of low height inflatable cells 250 attached to the contoured base surface 240. The contoured surface 240 can be made of plastic, foam, rubber or any other suitable material and can be shaped based on an average person's measurements in the sitting area. The low height cells 250 can have height lower than the height of cells 40 and can be used for fine tuning adjustments of the contour to closely match the shape of sitting bodies with different anatomies. FIG. 13B is a side view of the design of FIG. 13A clearly showing the position of the contouring base 240 with the cells 250 and the cells 40. FIG. 13C illustrates another example of contouring cushion 200 where a single slope wedge 260 or multi slope wedges 260 can be used to simulate the curvature of the body. The slope wedge 260 can be an inflatable wedge(s) or a foam/rubber wedge(s).

The controller 10 adjusts the pressure in each of the cell zones 42, 46, 420. For example, the user may require an ideal pressure distribution in each zone, so the controller 10 inflates all the inflatable cells in each cell zone at an optimal pressure defined based on user's parameters. The user can select if he/she prefers the controller 10 to automatically set the optimal pressure or the optimal pressure is manually inputted by the user or an expert. In the automatic approach, an algorithm implemented in the controller 10 can determine the optimal pressure using data obtained from the at least one pressure sensor and user's parameters such as weight, height, hip size, medical condition, etc. Several logics can be used to determine the optimal pressure automatically. In one approach, a look up chart can be made offline based on the weight and the size of the hip and the optimal pressure for each case can be found by proper pressure mapping system. The chart can then be programmed/inputted in the controller 10. The user or expert can customize the pressure distribution in the cushioning device by applying the weight and hip size into the controller 10, and the controller 10 will then determine the optimal pressure directly from the chart if those numbers match with a pre-programmed case, or if the numbers do not match, a statistical or intelligent algorithm will interpolate the values to find the closest match from the pre-programmed chart and determine the optimal pressure for the user's parameters (weight, hip size). The controller 10 can then send a signal to the pump 15 and the valves to inflate the cells to the required optimal pressure. In another implementation, to set the ideal pressure in the cushion automatically, the cushion can be over-inflated and the user will sit on it. Then the controller 10 will send signal to the valves to start deflating the cushion while reading the pressure at different intervals. The rate of deflation and the absolute pressure can be used as criteria to determine the optimal pressure. At the beginning, the rate of deflation will be high which means that the cells are over-inflated, however when the body weight and cell pressures come to balance each other the deflation rate drops. Body weight and the hip size can also be used together with the pressure rate (deflation rate) as indicators for the controller 10 to identify the optimal pressure during the deflation process.

In some implementation, additional sensors (not shown), such as flow meters can be used instead or in addition to the pressure sensors to identify the pressure automatically. In one embodiment, one or more flexible force sensors can be used to determine optimal pressure. For example, contact pressure points between hip and inflatable cells can first be found so that the flexible force sensors can be attached at such contact pressure points. The force sensors can be attached on each inflatable cell or attached only to some critical cells without departing from the scope of the invention. In operation, the inflatable cells can be first over inflated and then the user can sit on the cushion 100 and the controller 10 can trigger the inflation system to start deflating the cells, while reading the values of all force sensors at each time interval and processing such values to determine whether pre-defined threshold is reached. The process can be stopped when the measurements obtained from all force sensors are close enough to each other or no force sensor reports a value over the pre-defined threshold. In one implementation, a hybrid solution that integrates pressure sensor, flow meters, user's information (i.e. user's weight and hip size) and force sensors can be implemented to determine optimal pressure. The controller 10 can determine the optimal pressure using an algorithm that integrates all the measurements obtained from the sensors and determine a pattern for pressure distribution in the inflatable cell zones that can provide pressure that is evenly distributed on the hip and avoid deflating the cells completely (bottom down). One minimal sensor approach can be done by integrating one or more force sensors at critical positions and at least one pressure sensor. The force sensors do not necessarily need to be flexible and placed on top of the cells. The force sensor can be placed under the inflatable cell or between the cushioning layers or even under the cushion base 105. To achieve optimal pressure distribution, the cushioning device can be first inflated and then the user can sit on it. Then, the cushion can be deflated and the controller 10 can read the measurements obtained from the in real-time until a pre-determined value is obtained when the controller 10 can stop the deflation process by closing the valves. In one implementation, the controller 10 can also be programmed to find optimal pressure based on the trend of the force sensors in the deflation/inflation process. In the case that there are more than one force sensors in the cushion, the inflation/deflation can be stopped when all the values from the force sensors are within the prescribed recommended numbers. A combination of force sensors network (or single force sensor) with other sensors like pressure sensor and flow meters can also be implemented. Similarly, the optimal pressure can be obtained using the methods described herein above by having the user sit on the deflated cushion 100 and then inflating the cushion 100 until the optimal pressure is found according to some of the methods explained herein.

In some implementation, the optimal pressure can be automatically determined by measuring other variables, such as for example, height of all inflatable cells (or height of some critical cells). A displacement sensor (not shown), such as for example, a linear variable differential transformer (LVDT), string potentiometer, etc., can be used to measure the distance between the user's hip and a base of the cells. The cushion can be inflated and the user can sit on it. Then, the cushion can be deflated until a proper height is reached. In one embodiment, an electrical or mechanical switch (limit switch, push button, etc.) can be used to send a signal to the controller 10 to stop the inflation or deflation process as soon as the switch, at some pre-determined cell height, is turned off or on, indicating that the pre-determined cells' height has been reached.

The optimal pressure for the cushion can also be set up manually by the user or an expert. This can be done by observation. The cushion can be inflated and the user can sit on it to start the deflation until the user is satisfied with the pressure distribution. In one implementation, an insert (not shown) can be used to determine when the deflation should be stopped. The insert can be an insert with pre-determined height. A medical expert or user can place the insert in the cushion (between two layers or between two neighbouring cell zones) before the user sit on the cushion. During the deflation the expert/user can observe and test to see when pulling the insert out of the cushion is difficult. The level of resistance during pulling the insert out of the cushion defines the timing when the deflation process should be stopped.

The sitting position of the user can be automatically determined. In one implementation, the controller 10 can analyze the pressure measurements obtained from the sensors in certain, pre-determined, time intervals or in real-time. Any shift in the pressure may be due to a change of the sitting position. If the change pattern matches with a prescribed pattern for positioning (sitting) problem (e.g. constantly increasing, stable increase/decrease in the pressure), the controller 10 can trigger automatic problem shooting by slowly inflating one of the cell zones in, for example, the bottom layer 110, while continue monitoring the pressure changes in the top layer 120. If the pressure starts getting close to the pre-determined optimal pressure (or pressure that was pre-set), that will indicate that the position is being corrected. Otherwise, that zone will be deflated back to its original pressure and another zone of the bottom layer 110 can be tried. The process of trial and error can continue until the sitting position is corrected. In one embodiment, the values of the force sensors can be used to identify the positioning problem and then one cell zone or zone(s) can be inflated or deflated to correct the problem. The displacement sensors and the push-buttons/limit switches with proper height can also be used to identify the change in the sitting position (position problem). In one implementation, an alarm system (not shown) can be provided to alert the user or the caregiver about change of position and the correction procedure taken automatically by the controller 10. The controller's actions can be overridden by the user or the caregiver. In such situations, the cushion can go back to its recommended settings or a new setting determined by the user or caregiver can be manually inputted. In addition, the alarm can be manually activated by the user in case of emergency.

In one embodiment, the cushioning device can comprise one or more sensors configured to detect sliding forward. For example, such sensors can be an array of force sensors, the push buttons or limit switches placed under some of the cells, contact/displacement sensors in the back seat, array of force/pressure sensors in the back cushion or push button/limit switches in the back seat, pressure sensor on the air bladders of the back seat, etc. Based on the information obtained from such sensors, the controller 10 can detect the sliding disposition and provide alarming signal using the alarm system (e.g. a sound or visual alarm system). In one embodiment, the controller 10 can trigger inflation process to inflate cells that have a bigger height which are so positioned that can prevent the user sliding out of the chair when such cells are inflated to full or almost full height.

Intelligent real-time pressure adjustments in each cell zone can also be achieved based on prediction of wound healing outcome. For example, non-invasive modalities developed to assess wound healing potential, such as transcutaneous oximetry (tcpO2) or Skin Perfusion Pressure (SPP), can be used to monitor and predict spontaneous healing of the wound (ulcer) based on skin oxygenation or capillary perfusion. Such instruments can be attached to user's skin close to the wound area and they can send input signals to the controller 10, which can analyze such signals and can automatically adjust the pressure in the cells and pressure distribution to achieve optimal pressure that results in improved wound healing potential. The controller 10 may adjust the cushion's internal pressure in different regions/zones through various interactive machine leaning methods or pre-programmed algorithms suitable to the individual. For example, the controller can automatically change the internal pressure, as required, when the tcpO2 signal at the wound is lower than a pre-determined threshold to ensure proper healing is occurring.

In one embodiment, the controller 10 can communicate (wire/wireless) with a centre supervised by caregivers or medical experts to report the user's sitting status. The caregivers can remotely monitor the situation of the user and change in the prescribed settings, such as optimal pressure distribution, alternation mode, adjust pressure and timing. In addition, the controller 10 can communicate other vital information of the user to the caregivers, such as skin perfusion pressure, etc., using the information obtained from different sensors of the cushioning device.

While particular elements, embodiments and applications of the present disclosure have been shown and described, it will be understood, that the scope of the disclosure is not limited thereto, since modifications can be made by those skilled in the art without departing from the scope of the present disclosure, particularly in light of the foregoing teachings. Thus, for example, in any method or process disclosed herein, the acts or operations making up the method/process may be performed in any suitable sequence and are not necessarily limited to any particular disclosed sequence. Elements and components can be configured or arranged differently, combined, and/or eliminated in various embodiments. The various features and processes described above may be used independently of one another, or may be combined in various ways. All possible combinations and sub-combinations are intended to fall within the scope of this disclosure. Reference throughout this disclosure to "some embodiments," "an embodiment," or the like, means that a particular feature, structure, step, process, or characteristic described in connection with the embodiment is included in at least one embodiment. Thus, appearances of the phrases "in some embodiments," "in an embodiment," or the like, throughout this disclosure are not necessarily all referring to the same embodiment and may refer to one or more of the same or different embodiments.

Various aspects and advantages of the embodiments have been described where appropriate. It is to be understood that not necessarily all such aspects or advantages may be achieved in accordance with any particular embodiment. Thus, for example, it should be recognized that the various embodiments may be carried out in a manner that achieves or optimizes one advantage or group of advantages as taught herein without necessarily achieving other aspects or advantages as may be taught or suggested herein.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without operator input or prompting, whether these features, elements and/or steps are included or are to be performed in any particular embodiment. No single feature or group of features is required for or indispensable to any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

The example results and parameters of the embodiments described herein are intended to illustrate and not to limit the disclosed embodiments. Other embodiments can be configured and/or operated differently than the illustrative examples described herein.

The invention claimed is:

1. An inflatable cushioning device comprising:

a plurality of inflatable split cells and an entrance port, each of the plurality of inflatable split cells having an air sealed wall defining an inner cavity of the inflatable cell, each split cell comprising a lower base configured as a single air cell and a set of two or more adjacent upper air cells with smaller cross-section than a cross-section of the lower base, the lower single cell base being a support for the two or more upper adjacent air cells such that the two or more adjacent upper air cells being adjustable to conform to a shape of a contact body increasing a stability of the cushioning device, the entrance port providing a fluid communication with the inner cavity of the plurality of inflatable split cells;

an inflation system comprising a fluid flowing system and a fluid regulator and being configured to inflate and deflate the plurality of inflatable split cells, the inflation system being in fluid communication with the entrance port to provide fluid into and out of the inner cavity of the plurality of inflatable split cells;

one or more sensors in communication with the plurality of inflatable split cells and configured to measure at least one parameter of the plurality of inflatable split cells;

a controller having an input unit, an output unit and a processing unit, the controller being in communication with the one or more sensors and the inflation system to receive a signal from the one or more sensors as an input information, and to send a trigger signal to the inflation system to adjust a pressure in each of the plurality of inflatable split cells; and a remote control device in communication with the controller, the remote control device having an input interface for an operator to provide input information to the controller and an output interface for the operator to observe parameters of the inflatable cushioning device and its settings, wherein the controller uses the input information obtained from the one or more sensors and the input information provided by the operator using the remote controller to actuate the inflation system and adjust the pressure in the inflatable split cells based on such input information.

2. The inflatable cushioning device of claim 1, wherein two or more of the plurality of inflatable split cells being interconnected together using a network of channels forming a cell zone, a shape and a size of each zone being adjustable, wherein the entrance port provides access to the inner cavity of all inflatable split cells in the cell zone and the fluid flows between each of the inflatable split cells in the cell zone.

3. The inflatable cushioning device of claim 2, wherein the plurality of inflatable split cells being grouped in two or more independent cell zones, the controller being in communication with each of the two or more independent cell zones to independently adjust the pressure in each of the independent cell zones.

4. The inflatable cushioning device of claim 3, wherein the independent cell zones and individual inflatable split cells being arranged into a pre-determined pattern.

5. The inflatable cushioning device of claim 3, further comprising a flow channel configured to connect two or more cell zones to provide fluid communication between the inflatable split cells of the two or more cell zones, and a valve mounted to the flow channel, the controller being in communication with the valve to control the fluid flow in the flow channel between two or more cell zones.

6. The inflatable cushioning device of claim 2, wherein the plurality of inflatable split cells are grouped in a plurality of cell zones, wherein the split cells of one cell zone are being stacked one over the split cells of another cell zone.

7. The inflatable cushioning device of claim 1, wherein the plurality of inflatable split cells being interconnected together using a network of channels, the inflatable cushioning device further comprising at least one plug configured to be inserted at a pre-determined position in the network of channels to block a channel at such position and terminate the connection between the inflatable cells forming separate and independent cell zones, wherein a size and a shape of each of the independent cell zones being adjustable by repositioning the at least one plug.

8. The inflatable cushioning device of claim 1, wherein the remote control device is a computer, a tablet or a smart phone having a software program configured to provide input to the input unit of the controller.

9. The inflatable cushioning device of claim 1, further comprising a base plate, the plurality of inflatable split cells being attachable to the base plate.

10. The inflatable cushioning device of claim 9, wherein the base plate being inflatable, the controller being in communication with the base plate to adjust the pressure in the base plate.

11. The inflatable cushioning device of claim 9, wherein the base plate having a contoured surface.

12. The inflatable cushioning device of claim 1, further comprising at least two cushioning layers of plurality of inflatable split cells, the plurality of inflatable split cells being an upper cushioning layer that are stacked over the plurality of inflatable cells in a lower cushioning layer, the plurality of inflatable cells in at least one of the layers being interconnected to form at least one independent cell zone.

13. The inflatable cushioning device of claim 12, further comprising a dividing layer mounted between the at least two cushioning layers, the plurality of inflatable split cells of the upper layer being attachable to the dividing layer.

14. The inflatable cushioning device of claim 1, further comprising a moisture removal system comprising a flexible hose with a porous wall and a fluid flow system in communication with the hose, the hose being positioned between the plurality of the inflatable split cells in proximity to a top surface of the cushioning device, the controller being in communication with the fluid flow system of the moisture removal system to actuate the fluid flow through the hose.

15. The inflatable cushioning device of claim 14, further comprising at least one moisture detection sensor to detect and measure moisture in the cushioning device and provide a signal to the controller, the controller being configured to trigger the fluid flow system of the moisture removal system based on the signal obtained from the at least one moisture detection sensor.

16. The inflatable cushioning device of claim 1, wherein the plurality of the inflatable split cells have different shapes, sizes and heights and being arranged in a pre-determined pattern.

17. The inflatable cushioning device of claim 1, wherein the controller being programmed to automatically determine an optimal pressure in each of the plurality of inflatable split cells.

18. The inflatable cushioning device of claim 1, wherein an optimal pressure in each of the plurality of inflatable split cells is being manually set up by an operator.

19. The inflatable cushioning device of claim 1, wherein the controller is being programmed to automatically alternate pressure in the inflatable split cells in order to provide alternating pressure distribution in the inflatable split cells, a timing and a sequence of pressure alternation being pre-determined.

20. The inflatable cushioning device of claim 1, wherein the one or more sensors is at least one of a pressure sensor, a flow meter, a force sensor or a displacement sensor.

21. The inflatable cushioning device of claim 20, wherein the one or more sensors are positioned at a contact pressure point.

22. The inflatable cushioning device of claim 1, further comprising at least one non-inflatable malleable cell.

23. The inflatable cushioning device of claim 1 further comprising surrounding cell zones, each surrounding cell zone comprising at least one inflatable cell, the surrounding cell zones being external to the plurality of inflatable split cells and independent therefrom, the surrounding cell zones being configured to stabilize a position of a user.

24. The inflatable cushioning device of claim 16, wherein the number of inflatable split cells and their arrangement is determined based on a user's hip size.

* * * * *